US007228091B2

(12) United States Patent
Hays et al.

(10) Patent No.: US 7,228,091 B2
(45) Date of Patent: Jun. 5, 2007

(54) COMPACT CHARGING METHOD AND DEVICE WITH GAS IONS PRODUCED BY ELECTRIC FIELD ELECTRON EMISSION AND IONIZATION FROM NANOTUBES

(75) Inventors: Dan A. Hays, Fairport, NY (US); Steven B. Bolte, Rochester, NY (US); Michael F. Zona, Holley, NY (US); Joel A. Kubby, Santa Cruz, CA (US)

(73) Assignee: Xerox Corporation, Stamford, CT (US)

( * ) Notice: Subject to any disclaimer, the term of this patent is extended or adjusted under 35 U.S.C. 154(b) by 71 days.

(21) Appl. No.: 11/149,392

(22) Filed: Jun. 10, 2005

(65) Prior Publication Data

US 2006/0280524 A1 Dec. 14, 2006

(51) Int. Cl.
*G03G 15/02* (2006.01)

(52) U.S. Cl. ..... 399/168

(58) Field of Classification Search ..... 399/136, 399/168, 170, 171, 173, 310, 315, 343; 361/212, 361/213, 225, 226, 229, 230; 430/48, 55, 430/902; 347/140; 250/324, 325, 326
See application file for complete search history.

(56) References Cited

U.S. PATENT DOCUMENTS

| | | | | |
|---|---|---|---|---|
| 4,672,505 | A * | 6/1987 | Tsuchiya et al. | 250/324 X |
| 5,077,468 | A * | 12/1991 | Hamade | 250/324 |
| 5,381,216 | A * | 1/1995 | Osaka et al. | 399/315 |
| 5,539,205 | A * | 7/1996 | Reale | 250/326 |
| 6,493,529 | B1 * | 12/2002 | Umemura et al. | 399/168 |
| 6,526,244 | B1 | 2/2003 | Viturro et al. | 399/237 |
| 7,085,125 | B2 * | 8/2006 | Sung | 361/502 |
| 2004/0184840 | A1 | 9/2004 | Hays | 399/252 |

* cited by examiner

*Primary Examiner*—Sandra L. Brase
(74) *Attorney, Agent, or Firm*—MH2 Technology Law Group

(57) ABSTRACT

In accordance with the invention, there is an electrophotographic charging device comprising a first electrode, a second electrode adjacent the first electrode, a plurality of nanotubes adhering to at least one of the first electrode and the second electrode, and a voltage supply electrically connected to the first electrode and the second electrode, wherein the first electrode and the second electrode impart charge to a portion of a gaseous material that is deposited on a receptor.

24 Claims, 3 Drawing Sheets

COMPACT CHARGING METHOD AND DEVICE WITH GAS IONS PRODUCED BY ELECTRIC FIELD ELECTRON EMISSION AND IONIZATION FROM NANOTUBES

DESCRIPTION OF THE INVENTION

1. Field of the Invention

The subject matter of this application relates to charging devices. More particularly, the subject matter of this application relates to charging devices having nanotubes, such as carbon nanotubes, where the charging devices can be used in electrophotographic apparatus.

2. Background

In the electrophotographic process, various charging devices are needed to charge a photoreceptor, recharge a toner layer, charge an intermediate transfer belt for electrostatic transfer of toner, or charge a sheet of media, such as a sheet of paper. Conventional charging devices typically apply high AC/DC voltages to wires or pins in non-contacting devices, such as corotrons, scorotrons, and dicorotrons. Alternative devices use AC/DC biased charging rolls in contact with a receptor. Air ionization by high electric fields produces gaseous ions for charging. However, undesired highly reactive oxidizing species are also generated in the process that can degrade the photoreceptor and can cause air pollution.

Moreover, conventional charging devices require a large voltage and a large size (e.g., the length in the process direction) for high process speed electrophotographic machines.

Thus, there is a need to overcome these and other problems of the prior art to provide a method and system to reduce the size, and the voltage required for charging the receptor, and to reduce the undesired reactive oxidizing species generated through the charging process.

SUMMARY

In accordance with the invention, there is an electrophotographic charging device comprising a first electrode, a second electrode adjacent the first electrode, a plurality of nanotubes adhering to at least one of the first electrode and the second electrode, and a voltage supply electrically connected to the first electrode and the second electrode, wherein the first electrode and/or the second electrode impart charge to a portion of a gaseous material that is deposited on a receptor.

According to another embodiment of the invention, there is an electrophotraphic charging device comprising a first electrode, a second electrode separated from the first electrode by a gap, and a plurality of nanotubes adhering to at least one of the first electrode and the second electrode. The electrophotographic charging device can also include a receptor positioned adjacent to the gap separating the first electrode from the second electrode and an aperture electrode in close proximity to the gap separating the first electrode and the second electrode and positioned in a space between the receptor and the first electrode and the second electrode. In the electrophotographic charging device, a first voltage supply can be connected between the first electrode and the second electrode and a second voltage supply can be connected between the aperture electrode and the substrate of the receptor.

According to another embodiment of the invention, there is a method of charging a receptor in an electrophotographic charging device, the method comprising applying a first voltage between a first electrode and a second electrode, wherein at least one of the first electrode and the second electrode are coated by a plurality of nanotubes, supplying a gaseous material between the first and second electrode, such that an electric field on the nanotubes either electron charges or ionizes a portion of the gaseous material, and directing the electron charged or ionized gaseous material towards a receptor.

It is to be understood that both the foregoing general description and the following detailed description are exemplary and explanatory only and are not restrictive of the invention, as claimed.

The accompanying drawings, which are incorporated in and constitute a part of this specification, illustrate one several embodiments of the invention and together with the description, serve to explain the principles of the invention.

DESCRIPTION OF THE EMBODIMENTS

Reference will now be made in detail to exemplary embodiments of the invention, examples of which are illustrated in the accompanying drawings. Wherever possible, the same reference numbers will be used throughout the drawings to refer to the same or like parts.

Figure 1:
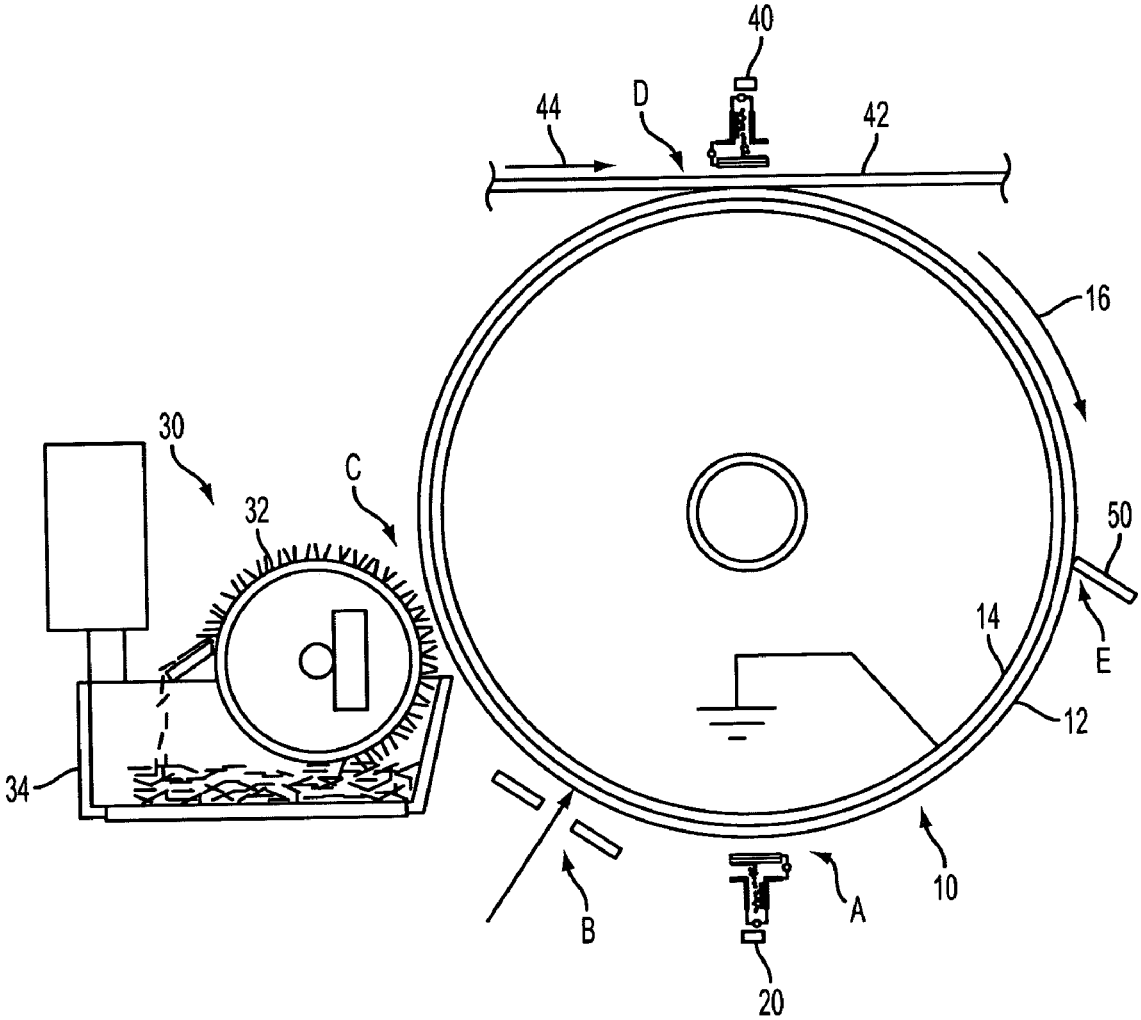
FIG. 1 is a schematic view showing an electrophotraphic printing apparatus according to various embodiments of the invention.

Referring initially to FIG. 1, prior to describing the specific features of the exemplary embodiments, a schematic depiction of the various components of an exemplary electrophotographic reproduction apparatus incorporating charging devices, various embodiments of which are described in more detail below, is provided. Although the exemplary apparatus is particularly well adapted for use in an electrophotographic reproduction machine, it will be apparent from the following discussion that the present corona generating device is equally well suited for use in a wide variety of electrostatographic processing machines as well as other systems that include the use of a charging device. In particular, it should be noted that the charging devices of the exemplary embodiments can also be used in the toner transfer, detack, or cleaning subsystems of a typical electrostatographic copying or printing apparatus because such subsystems can include the use of a charging device.

The exemplary electrophotographic reproducing apparatus of FIG. 1 can comprise a drum including a photoconductive surface 12 deposited on an electrically grounded conductive substrate 14. A motor (not shown) engages with drum 10 for rotating the drum 10 in the direction of arrow 16 to advance successive portions of photoconductive surface face 12 through various processing stations disposed about the path of movement thereof, as will be described. Initially, a portion of drum 10 passes through charging station A. At charging station A, a charging device, indicated generally by reference numeral 20, charges the photoconductive surface 12 on drum 10 to a relatively high potential.

Once charged, the photoconductive surface 12 can be advanced to imaging station B where an original document (not shown) can be exposed to a light source (also not shown) for forming a light image of the original document onto the charged portion of photoconductive surface 12 to selectively dissipate the charge thereon, thereby recording onto drum 10 an electrostatic latent image corresponding to the original document.

One skilled in the art will appreciate that various method can be used to irradiate the charged portion of the photoconductive surface 12 for recording the latent image thereon. For example, a properly modulated scanning beam of electromagnetic radiation (e.g., a laser beam) can be used to irradiate the portion of the photoconductive surface 12.

After the electrostatic latent image is recorded on photoconductive surface 12, the drum is advanced to development station C where a development system, such as a so-called magnetic brush developer, indicated generally by the reference numeral 30, deposits developing material onto the electrostatic latent image.

The exemplary development system 30 shown in FIG. 1 includes a single development roller 32 disposed in a housing 34, in which toner particles are typically triboelectrically charged by mixing with larger, conductive carrier beads in a sump to form a developer that is loaded onto developer roller 32 that can have internal magnets to provide developer loading, transport, and development. The developer roll 32 having a layer of developer with the triboelectric charged toner particles attached thereto can rotate to the development zone whereupon the magnetic brush develops a toner image on the photoconductive surface 12. It will be understood by those skilled in the art that numerous types of development systems can be used.

Referring again to FIG. 1, after the toner particles have been deposited onto the electrostatic latent image for development, drum 10 advances the developed image to transfer station D, where a sheet of support material 42 is moved into contact with the developed toner image in a timed sequence so that the developed image on the photoconductive surface 12 contacts the advancing sheet of support material 42 at transfer station D. A charging device 40 can be provided for creating an electrostatic charge on the backside of support material 42 to aid in inducing the transfer of toner from the developed image on photoconductive surface 12 to the support material 42.

After image transfer to support material 42, support material 42 is subsequently transported in the direction of arrow 44 for placement onto a conveyor (not shown) which advances the support material 42 to a fusing station (not shown) that permanently affixes the transferred image to the support material 42 thereby for a copy or print for subsequent removal of the finished copy by an operator.

According to various embodiments, after the support material 42 is separated from the photoconductive surface 12 of drum 10, some residual developing material can remain adhered to the photoconductive surface 12. Thus, a final processing station, such a cleaning station E, can be provided for removing residual toner particles from photoconductive surface 12 subsequent to separation of the support material 42 from drum 10.

Cleaning station E can include various mechanisms, such as a simple blade 50, as shown, or a rotatably mounted fibrous brush (not shown) for physical engagement with photoconductive surface 12 to remove toner particles therefrom. Cleaning station E can also include a discharge lamp (not shown) for flooding the photoconductive surface 12 with light in order to dissipate any residual electrostatic charge remaining thereon in preparation for a subsequent image cycle.

According to various embodiments, an electrostatographic reproducing apparatus may take the form of several well known devices or systems. Variations of the specific electrostatographic processing subsystems or processes described herein can be applied without affecting the operation of the present invention.

Figure 2:
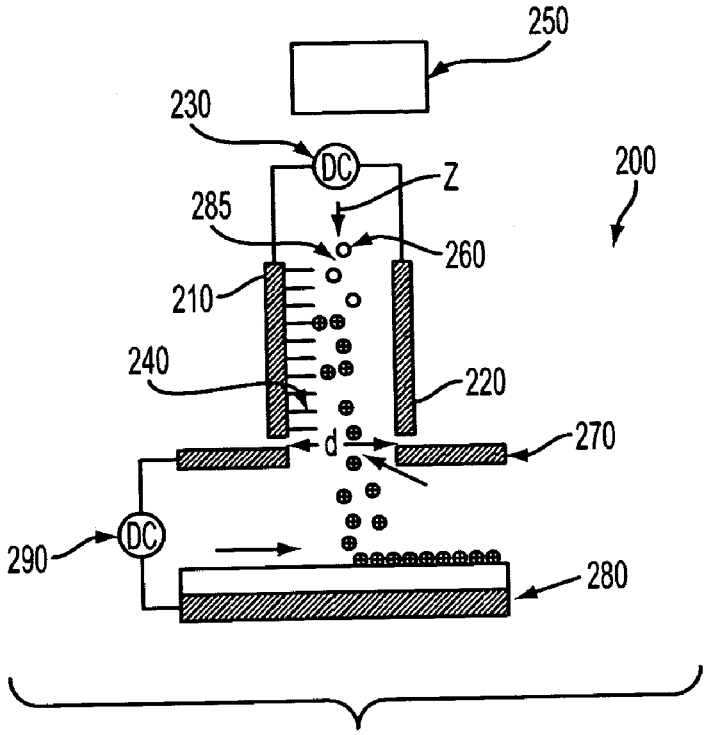
FIG. 2 depicts an exemplary charging device according to various embodiments of the invention.
Figure 3:
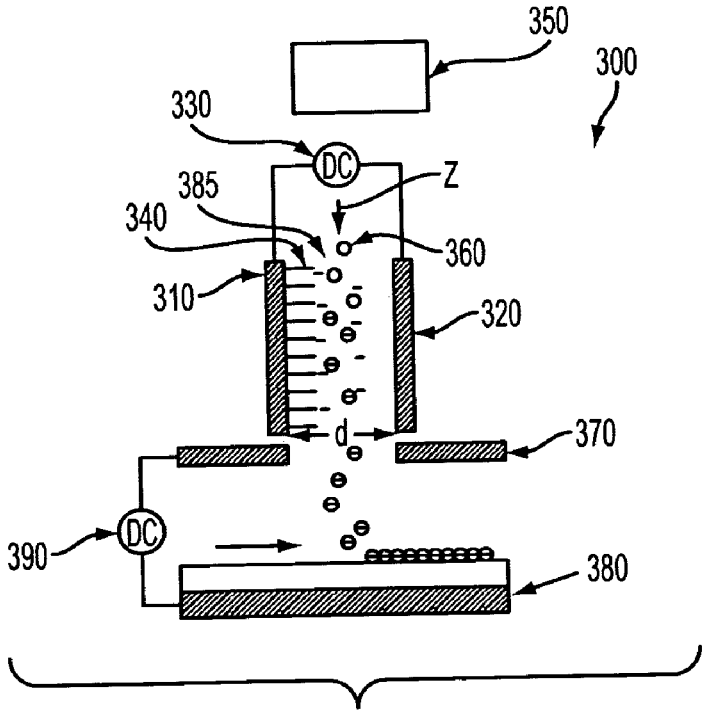
FIG. 3 depicts another exemplary charging device according to various embodiments of the invention.
Figure 4:
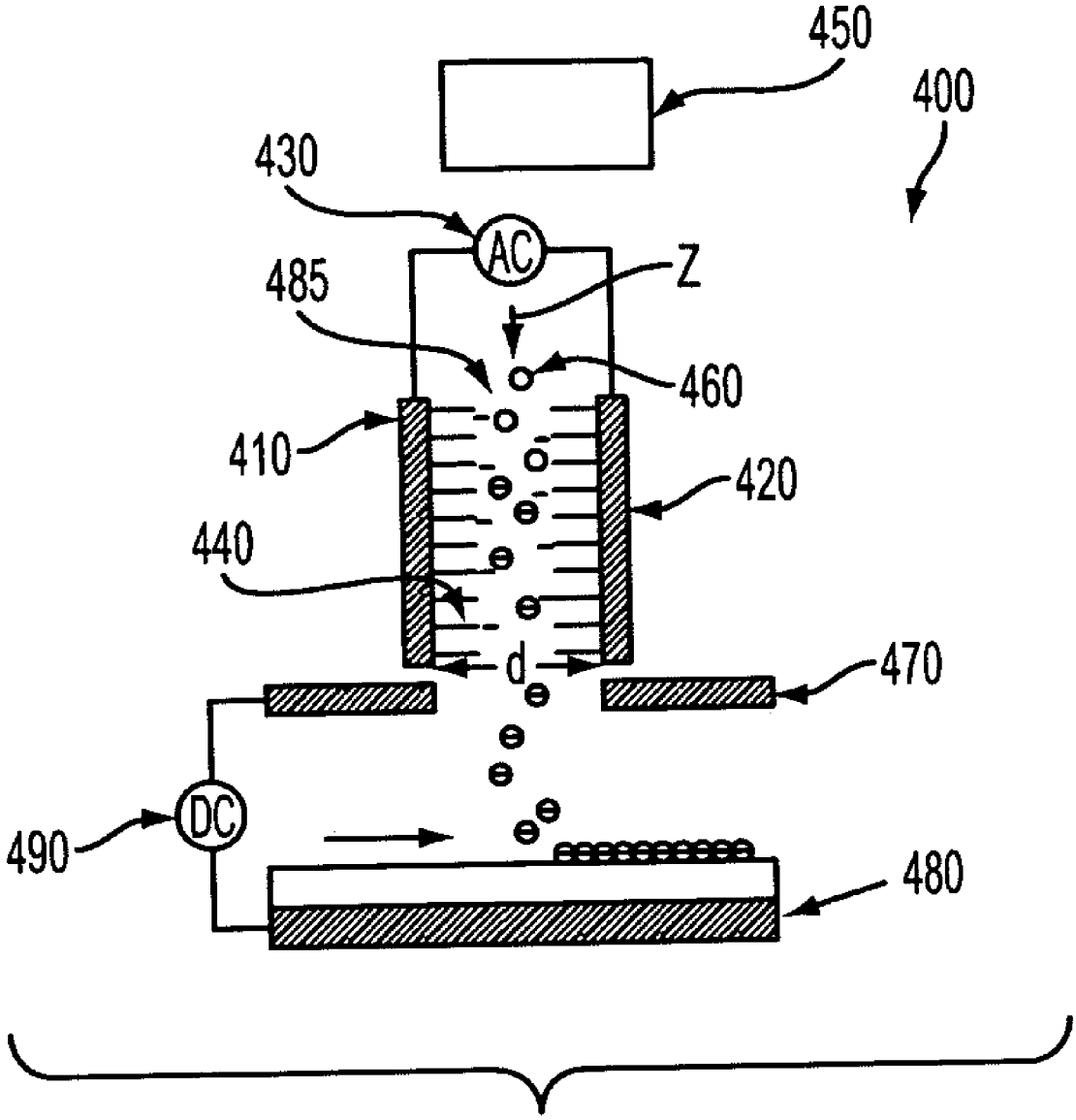
FIG. 4 depicts another exemplary charging device according to various embodiments of the invention.

FIGS. 2-4 depict various charging devices that can be used to charge a receptor in, for example, the electrophotographic process, while using less voltage and producing a reduced amount of oxidizing agents. Exemplary receptors can include a photoreceptor, such as the photoconductive surface 12, a toner layer, a sheet of media on which toner can be deposited, or a transfer belt.

According to various embodiments, the charging devices described herein can comprise a compact positive charging device in which a gaseous material comprising gas molecules and/or atoms can be ionized by a high electric field using nanotubes. According to other embodiments, the charging device can comprise a compact negative charging device in which negative ion gas molecules and/or atoms can be generated by exposing the gaseous material to a high electric field electron emission using nanotubes.

FIG. 2 shows an exemplary charging device 200 according to various embodiments. As shown in FIG. 2, the charging device 200 can comprise a first electrode 210, a second electrode 220, a first DC voltage supply 230 electrically connected to the first electrode and the second electrode, a plurality of nanotubes 240 physically contacting or being adhered to the first electrode 210, a gas supply unit 250 that can supply a gaseous material 260 into a charging zone 285, also called a gap, between the first electrode 210 and the second electrode 220, and a grid 270 (or aperture electrode). The charging device 200 can be used to supply charge to the receptor 280. While FIG. 2 shows the plurality of nanotubes adhering to the first electrode 210, it will be understood that in various embodiments, the plurality of nanotubes can be formed on the first electrode 210 and/or the second electrode 220. Moreover, it should be understood that any number of multiple electrodes can be appropriately configured to form the charging zone 285. Still further, it should be understood that there can be multiple, closely spaced charging zones 285 arranged in the process direction to allow high process speed charging of the receptor 280.

According to various embodiments, the substrates of the first electrode and the second electrode can be made from various conductive materials such as metals, indium tin oxide coated glass and conductive organic composite materials. The dimensions of the electrodes are typically centimeters in the direction of the gas flow and tens of centimeters perpendicular in the cross process direction. Further, the first electrode and the second electrode can be closely spaced, separated by a distance (d). The distance (d) can be, for example, from about 10 μm to about 500 μm, or from about 100 μm to about 300 μm. The electrodes can be arranged substantially parallel to, and opposing, one another to form the charging zone 285 between the first electrode 210 and the second electrode 220.

According to various embodiments, the nanotubes 240 can comprise various materials, such as, carbon, boron nitride, zinc oxide, bismuth, and metal chalcogenides. In addition, the nanotubes can be overcoated or surface modified to achieve operational stability in various gas environments. As used herein, the term nanotubes will be understood to mean single-walled nanotubes (SWNT), multi-walled nanotubes (MWNT), horns, spirals, wires, and/or fibers. Typically, nanotubes can be 1 to 10 nanometers in diameter and can be up to hundreds of microns in length. By controlling various parameters, such as composition, shape, length, etc., the electrical, mechanical, and thermal properties of the nanotubes can be controlled. For example, the nanotubes can be formed to be conducting, semiconducting, or insulating, depending on, for example, the chirality of the nanotubes. Moreover, the nanotubes can have yield stresses greater than that of steel. Additionally, the nanotubes can have thermal conductivities greater than that of copper, and in some cases, comparable to, or greater than that of diamond.

According to various embodiments, the nanotubes can be fabricated by a number of methods including arc discharge, pulsed laser vaporization, chemical vapor deposition (CVD), and high pressure carbon monoxide processing. However, it will be understood by those of ordinary skill in the art that other fabrication methods can also be used. According to various embodiments, the nanotubes 240 can be formed to have their principle axis perpendicular to the substrate on which they are adhered, such as the first electrode 210 and/or the second electrode 220. In the case of fabrication using CVD with a catalyst, the nanotubes can be SWNT and can orient perpendicular to the substrate as shown, for example, in FIGS. 2-4.

According to various embodiments, nanotubes 240 can be irregularly and in certain embodiments, regularly spaced on at least a portion of one of the first electrode 210 and/or second electrode 220. As used herein, the term regularly spaced is understood to mean that the nanotubes are spaced apart from each other at a distance that is typically greater than an average height of the nanotubes. In some embodiments, the nanotubes can form a regular lattice such as a hexagonal array.

According to various embodiments, the first DC voltage supply 230 can apply a positive DC bias to the electrode comprising the nanotubes, such as the first electrode 210 shown in FIG. 2. The positive DC bias can cause electric field ionization of the gaseous material 260 near the nanotubes. According to various embodiments, the first DC voltage supply 230 can provide a voltage of from about 100V to about 1500V between the first electrode 210 and the second electrode 220. Further, according to various embodiments, maximum field ionization can be obtained when the nanotubes are regularly spaced and oriented generally perpendicularly to the conductive substrate.

For example, as shown in FIG. 2, gaseous material 260 can enter charging device 200 from gas supply unit 250. The positive bias applied to the first electrode 210 can cause a portion of the gaseous material 260 to become positively charged, as represented by gaseous material in the charging zone 285 being labeled with a plus (+) sign.

As shown in FIG. 2, the ionized gaseous material 260 flowing through the charging zone 285 passes through grid 270. A second DC voltage supply 290 can be electrically connected between the grid 270 and the substrate of the receptor 280. According to various embodiments, the second DC voltage supply 290 can apply a positive DC bias to the grid 270 and can establish an electric field between the ion charging device and the receptor 280. According to various embodiments, the second DC voltage supply 290 can provide a voltage of about +400 volts to about +800 volts between the grid 270 and the receptor 280. When the surface potential of the receptor 280 becomes comparable to the positive DC bias applied by the second DC voltage supply 290, the charging of the receptor 280 ceases and the surface potential of the receptor is approximately equal to the voltage supply 290. According to various embodiments, the receptor 280 can acquire a relatively uniform surface potential even in cases where the ion current is not necessarily uniform in the cross process direction.

According to an exemplary embodiment for positive charging, the gaseous material 260 can comprise an inert gas, such as helium, $N_2$, $O_2$, and $H_2O$. The gaseous material 260 can be ionized when exposed to an intensified electric field at the ends of nanotubes. For example, helium, which has a relatively high ionization potential of about 24.6 eV, can be ionized. In this exemplary embodiment, helium can be ionized in a high vacuum condition when a positive bias in the range of 5 to 9 kV is applied to the nanotube covered electrode, spaced about 20 mm from a grounded electron channel multiplier. For gasses with lower ionization potentials, the field ionization threshold can be reduced. Other exemplary ionization potentials include 14.5 eV for $N_2$, 13.6 for $O_2$, and 12.6 for $H_2O$. The reduction in the ionization field at a tip, such as the tip of a nanotube, for these gasses, as compared to helium, are 0.38, 0.33, and 0.28, respectively. Moreover, the barrier penetration coefficient (D) for tunneling of an electron from a gas molecule at a critical distance for field ionization $x_c$ in units of cm from a tip can be expressed by:

$$D(x_c)=\exp\{-4.55\times10^7(I-7.60\times10^{-4}F^{0.5})^{0.5})(I-\Phi)/F\}$$

$$x_c=(I-\Phi)/F$$

where I is the ionization potential of the gas molecule and Φ is the work function of the tip with both quantities expressed in units of electron volts (eV). F is the electric field at the tip in units of V/cm, and $x_c$ is the distance of greatest penetration probability for an electron tunneling from an atom or a molecule into a nanotube tip.

According to various embodiments, the gas supply unit 250 can be provided by either compressors, blowers or pressurized gas cylinders. For example, the gas supply unit 250 can supply the gaseous material 260 at very high speeds through the charging zone 285 generally in a direction Z. In some embodiments, the gas supply unit 250 can flow the gaseous material 260 in an air or gas stream near the speed of sound i.e., about 340 m/s. Alternatively, the gas speeds can be from about 100 m/s to about 300 m/s. According to various embodiments, the drift speed of the ionized gaseous material 260 from the first electrode to the second electrode can be between 50 m/s and 250 m/s, and in some cases, near 100 m/s. According to various embodiments, flowing the gaseous material 260 at relatively high speeds can prevent ion deposition on the electrodes, such as the second electrode, which in this case is not covered with nanotubes. Instead of a DC voltage between the first electrode 210 and the second electrode 220, a pulsed voltage source can be used with a wave shape that provides a time average field near zero. Moreover, in certain embodiments to achieve field ionization, the macroscopic electric field in the gap between the first electrode 210 and the second electrode 220 can be in the range of about 1 V/μm to about 4 V/μm. The mobility of the ions in the gaseous material 260 is typically about 1 $cm^2/Vs$.

While not intending to be limited to any particular theory, it is believed that by applying the positive bias to the first electrode, the high electric field near the tips of the nanotubes can cause ionization (e.g., electron removal) of gas molecules or atoms in the gaseous material 260 flowing through charging zone 285. According to various embodiments, the second DC voltage supply 290 applied between the charging device 200 and the receptor 280 can provide an ion deposition electric field that collapses when the surface potential on the receptor 280 becomes comparable to that of charging device bias from the second DC voltage supply 290. According to various embodiments, the charging device 200 can enable a small size (e.g., the length in the process direction) without producing undesired molecular species, such as oxidizing agents of ozone and nitric oxides, for example.

FIG. 3 shows another exemplary charging device 300 according to various embodiments. As shown in FIG. 3, the charging device 300 can comprise a first electrode 310, a second electrode 320, a first DC voltage supply 330 electrically connected to the first electrode 310 and the second electrode 320, a plurality of nanotubes 340 physically adhering to the first electrode 310, a gas supply unit 350 that can supply a gaseous material 360 into a charging zone 385, also called a gap, between the first electrode 310 and the second electrode 320, and a grid 370 (or aperture electrode). The charging device 300 can be used to supply charge to the receptor 380. While FIG. 3 shows the plurality of nanotubes adhering to the first electrode 310, it will be understood that in various embodiments, the plurality of nanotubes can be formed on the first electrode 310 and/or the second electrode 320. Moreover, it should be understood that any number of multiple electrodes can be appropriately configured to form the charging zone 385. Still further, it should be understood that there can be multiple, closely spaced charging zones 385 arranged in the process direction to allow high process speed charging of the receptor 380.

According to various embodiments, the first electrode 310, the second electrode 320, including their arrangement, the nanotubes 340 including their arrangement, the gas supply unit 350, the grid 370, and the receptor 380 can be similar to those described above.

According to various embodiments, the first DC voltage supply 330 can apply a negative DC bias to the electrode comprising the nanotubes, such as the first electrode 310 shown in FIG. 3. The negative DC bias can cause an electron field emission from the nanotubes 340. The electron field emission supplies electrons, shown as a negative sign (−) in FIG. 3, to the charging zone 385. According to various embodiments, the first DC voltage supply 330 can provide a voltage of from about 100V to about 1500V between the first electrode 310 and the second electrode 320. Further, according to various embodiments, maximum electron field emission can be obtained when the nanotubes are regularly spaced and oriented generally perpendicularly to the conductive substrate.

For example, as shown in FIG. 3, gaseous material 360 can enter charging device 300 from gas supply unit 350. The negative bias applied to the first electrode 310 can supply electrons to the charging zone 385. Further, the electrons can cause a portion of the gaseous material 360 to become negatively charged, as represented by gaseous material 360 in the charging zone 385 being labeled with a negative (−) sign.

As shown in FIG. 3, the ionized gaseous material 360 flowing through charging zone 385 passes through grid 370. A second DC voltage supply 390 can be electrically connected between the grid 370 and the receptor 380. According to various embodiments, the second DC voltage supply 390 can apply a negative bias to the grid 370 (or aperture electrode). The negative DC biased grid 370 can establish an electric filed between the charging device 300 and the receptor 380. According to various embodiments, the second DC voltage supply 390 can provide a voltage of from about −400 volts to about −800 volts between the grid 370 and the receptor 380. When the surface potential of the receptor 380 becomes comparable to the negative DC bias applied by the second DC voltage supply 390, the charging on the receptor 380 ceases and the surface potential of the receptor can be approximately equal to the voltage supply 290. According to various embodiments, the receptor 380 can acquire a uniform surface potential even though the ion current may not necessarily be uniform in the cross process direction.

According to various embodiments, the gaseous material 360 flowing through the charging device 300 can contain electronegative molecular species to facilitate electron attachment on the gas molecules. For example, when air is used as the gaseous material 360, the dominant negative ion species at atmospheric pressure is $CO_3^-$. The precursor of $CO_3^-$ is $CO_2$ that reacts with $O^-$ or $O_3^-$ to form the $CO_3^-$ ion. Other examples of electronegative gaseous materials that can be used include, for example, $CO_2$ and $O_2$.

According to various embodiments, the gas supply unit 350 can be provided by either compressors, blowers or pressurized gas cylinders. For example, the gas supply unit 350 can supply the gaseous material 360 at very high speeds through the charging zone 385 generally in a direction Z. In some embodiments, the gas supply unit 350 can flow the gaseous material 360 in an air or gas stream near the speed of sound i.e., about 340 m/s Alternatively, the range of gas speeds can be from about 100 m/s to about 300 m/s. According to various embodiments, the drift speed of the ionized gaseous material 360 from the first electrode to the second electrode can be between 50 m/s and 250 m/s, and in some cases, near 100 m/s. According to various embodiments, flowing the gaseous material 360 at relatively high speeds can prevent ion deposition on the electrodes, such as the second electrode, which in this case is not covered with nanotubes. Instead of a DC voltage between the first electrode 310 and the second electrode 320, a pulsed voltage source can be used with a wave shape that provides a time average field near zero. Moreover, in certain embodiments to achieve electron field emission, the macroscopic electric field in the gap between the first electrode 310 and the second electrode 320 can be in the range of about 1 V/μm to about 4 V/μm. The mobility of the ions in the gaseous material 360 is typically about 1 $cm^2/Vs$.

FIG. 4 shows another exemplary charging device 400, according to various embodiments. As shown in FIG. 4, the charging device 400 can comprise a first electrode 410, a second electrode 420, an AC voltage supply 430 electrically connected to the first electrode 410 and the second electrode 420, a plurality of nanotubes 440 physically adhering to the first electrode 410 and the second electrode 420, a gas supply unit 450 that can supply a gaseous material 460, into a charging zone 485, also called a gap, between the first electrode 410 and the second electrode 420, and a grid 470 (or aperture electrode). The charging device 400 can supply charge to a receptor 480. It should be understood that any number of multiple electrodes can be appropriately configured to form the charging zone 485. Still further, it should be understood that there can be multiple, closely spaced charging zones 485 arranged in the process direction to allow high speed charging of the receptor 480.

According to various embodiments, the first electrode 410, the second electrode 420, including their arrangement, the nanotubes 440 including their arrangement, the gas supply unit 450, the grid 470, and the receptor 480 can be similar to those described above. Further, a second DC voltage supply 490 can be electrically connected between the grid 470 and the receptor 480 and function in a manner similar to the DC voltage supply 390 disclosed above.

In FIG. 4, both the first electrode 410 and the second electrode 420 are coated with nanotubes 440. A square wave AC voltage from AC voltage supply 430 can be applied between the first electrode 410 and the second electrode 420. Alternatively, a series of voltage pulses can be used instead of the steady DC voltage during each half cycle. During the half AC cycle, when one of the coated electrodes is at a negative potential and the other coated electrode is at a positive potential, electrons are field emitted into the charging zone 485 from the negatively biased electrode. During the next half cycle, the role of the coated electrodes is reversed. In this way, the gaseous material 460 flowing through the charging zone 485 can be alternately subjected to electrons from each of the nanotube covered electrodes.

According to various embodiments, when an electrode is at a positive potential, it is possible for gas molecules in the gaseous material 460 near the nanotubes to be field ionized. However, the threshold field for field ionization is typically larger than the threshold field for the electron emission.

According to various embodiments, if the AC frequency is sufficiently high to prevent ion deposition on the electrodes, the ions can undergo an oscillatory path while moving through the charging zone 485. In an exemplary embodiment, if the peak-to-peak amplitude of the ion oscillatory path is less than 1 mm, a frequency of greater than about 100 kHz can be used for a drift speed of 100 m/s. In this example, the gas speed through the charging device 400 can be as low as 10 m/s which is much less than speed of sound.

It should be appreciated that, while disclosed systems and methods have been described in conjunction with exemplary electrophotographic and/or xerographic image forming devices, systems and methods according to this disclosure are not limited to such applications. Exemplary embodiments of systems and methods according to this disclosure can be advantageously applied to virtually any device to which charge is to be imparted.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An electrophotographic charging device comprising:

a first electrode;

a second electrode adjacent the first electrode;

a plurality of nanotubes contacting at least one of the first electrode and the second electrode;

a first voltage supply electrically connected to the first electrode and the second electrode, wherein the first electrode and the second electrode impart charge to a portion of a gaseous material that is deposited on a receptor;

an aperture electrode positioned adjacent to the first electrode and the second electrode; and a second voltage supply electrically connected to the aperture electrode and the receptor.

2. The electrophotographic charging device according to claim 1 further comprising:

a gas supply unit that supplies the gaseous material between the first electrode and the second electrode.

3. The electrophotographic charging device according to claim 1, wherein the first electrode and the second electrode are separated by a distance from about 10 μm to about 500 μm.

4. The electrophotographic charging device according to claim 1, wherein the nanotubes comprise at least one of carbon, boron nitride, and zinc oxide, bismuth, and metal chalcogenides.

5. The electrophotographic charging device according to claim 4 wherein the nanotubes comprise at least one of single-walled nanotubes (SWNT), multi-walled nanotubes (MWNT), horns, spirals, wires, and fibers.

6. The electrophotographic charging device according to claim 5, wherein the nanotubes are regularly spaced on the at least one of the first electrode and second electrode such that the spacing is greater than an average height of the nanotubes.

7. The electrophotographic charging device according to claim 1, wherein the nanotubes are modified to achieve operational stability in a gas environment.

8. The electrophotographic charging device according to claim 1, wherein the nanotubes adhere to the first electrode, and wherein the first voltage supply provides a positive electrical bias to the first electrode.

9. The electrophotographic charging device according to claim 8, wherein the first voltage supply provides a voltage of from about 100V to about 1500V between the first electrode and the second electrode.

10. The electrophotgraphic charging device according to claim 1, wherein the nanotubes adhere to the first electrode, and wherein the voltage supply provides a negative electrical bias to the first electrode.

11. The electrophotographic charging device according to claim 10, wherein the negative voltage supply provides a voltage of from about 100V to about 1500V between the first electrode and the second electrode.

12. The electrophotographic charging device according to claim 1, wherein the nanotubes adhere to both the first electrode and the second electrode, and wherein the first voltage supply provides an AC electrical bias between the first electrode and the second electrode.

13. The electrophotographic charging device according to claim 12, wherein the AC voltage supply provides a voltage of from about 100V to about 1500V between the first electrode and the second electrode.

14. A printing device comprising:

the electrophotographic charging device according to claim 1.

15. An electrophotraphic charging device comprising:

a first electrode;

a second electrode separated from the first electrode by a gap;

a plurality of nanotubes contacting at least one of the first electrode and the second electrode;

a receptor positioned adjacent to the gap separating the first electrode from the second electrode;

an aperture electrode in close proximity to the gap separating the first electrode and the second electrode and positioned in a space between the receptor and the first electrode and the second electrode;

a first voltage supply connected between the first electrode and the second electrode; and a second voltage supply connected between the aperture electrode and the receptor.

16. The electrophotographic charging device according to claim 15 further comprising:

a gas supply unit that supplies a gaseous material through the gap.

17. The electrophotographic charging device according to claim 16, wherein an electric field on the nanotubes generated by the first voltage supply ionizes a portion of the gaseous material, and wherein the portion ionized gaseous material is directed to the receptor through the aperture electrode due to the second voltage supply providing a voltage between the aperture electrode and the receptor.

18. The electrophotgraphic charging device according to claim 17, wherein the first voltage supply provides a voltage of from about 100V to about 1500V between the first electrode and the second electrode.

19. The electrophotographic charging device according to claim 15, wherein the gap between the first electrode and the second electrode is a distance (d) from about 10 μm to about 500 μm.

20. The electrophotographic charging device according to claim 15, wherein the nanotubes comprise at least one of carbon, boron nitride, and zinc oxide, bismuth, and metal chalcogenides.

21. The electrophotographic charging device according to claim 15, wherein the nanotubes are modified to achieve operational stability in a gas environment.

22. A method of charging a receptor in an electrophotographic charging device, the method comprising:

applying a first voltage between a first electrode and a second electrode, wherein at least one of the first electrode and the second electrode are coated with a plurality of nanotubes;

supplying a gaseous material between the first and second electrode, such that an electric field on the nanotubes ionizes a portion of the gaseous material;

directing the ionized gaseous material towards a receptor; and applying a second voltage between an aperture electrode and the receptor.

23. The method of charging a receptor in an electrophotographic charging device according to claim 22, wherein the first voltage is from about 100V to about 1500V.

24. The method of charging a receptor in an electrophotographic charging device according to claim 22, wherein the nanotubes are coated on the first electrode, and wherein the first voltage supply provides a positive direct current (DC) bias to the first electrode.

* * * * *